US011027168B2

(12) United States Patent
Liao et al.

(10) Patent No.: US 11,027,168 B2
(45) Date of Patent: Jun. 8, 2021

(54) MANUAL TREADMILL WHICH CAN BE SET TO AN EXERCISE SPEED

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech. Co., Ltd., Taichung (TW)

( * ) Notice: Subject to any disclaimer, the term of this patent is extended or adjusted under 35 U.S.C. 154(b) by 15 days.

(21) Appl. No.: 16/423,121

(22) Filed: May 27, 2019

(65) Prior Publication Data

US 2020/0376329 A1 Dec. 3, 2020

(51) Int. Cl.

| | |
|---|---|
| ***A63B 22/02*** | (2006.01) |
| ***A63B 21/00*** | (2006.01) |
| ***A63B 21/005*** | (2006.01) |
| ***A63B 24/00*** | (2006.01) |
| ***A63B 71/06*** | (2006.01) |

(52) U.S. Cl.

CPC ..... *A63B 22/02* (2013.01); *A63B 21/0058* (2013.01); *A63B 21/00192* (2013.01); *A63B 24/0062* (2013.01); *A63B 2024/0093* (2013.01); *A63B 2071/0658* (2013.01); *A63B 2220/30* (2013.01)

(58) Field of Classification Search

CPC ..... A63B 22/02–0292; A63B 24/0087; A63B 2024/0093

See application file for complete search history.

(56) References Cited

U.S. PATENT DOCUMENTS

| | | | | |
|---|---|---|---|---|
| 10,556,168 | B2 * | 2/2020 | Fima | A63B 22/02 |
| 2012/0010048 | A1 * | 1/2012 | Bayerlein | A63B 22/0235 482/2 |
| 2017/0136289 | A1 * | 5/2017 | Frank | A63B 24/0087 |
| 2019/0168066 | A1 * | 6/2019 | Yoo | A63B 22/02 |

FOREIGN PATENT DOCUMENTS

| | | |
|---|---|---|
| CN | 202366380 U | 8/2012 |

* cited by examiner

*Primary Examiner* — Jennifer Robertson

(57) ABSTRACT

The present disclosure regards a manual treadmill. The manual treadmill includes a continuous belt coupled to a frame and adapted for an operator walking or running thereon; a sensing apparatus, sensing a parameter and producing a corresponding speed signal corresponding to a current rotating speed of the continuous belt; an inputting apparatus, producing an indication signal corresponding to a target rotating speed of the continuous belt; a control unit, receiving the corresponding speed signal to get a current speed value, receiving the indication signal to get a target speed value, and producing a first control signal; and a resistance adjusting apparatus, producing a resistance to impede the rotation of the continuous belt; wherein the control unit controls the resistance adjusting apparatus using the first control signal to decrease (or increase) the resistance when the current speed value is lower (or higher) than the target speed value.

15 Claims, 11 Drawing Sheets

MANUAL TREADMILL WHICH CAN BE SET TO AN EXERCISE SPEED

BACKGROUND

1. Field of the Invention

The present disclosure relates to a treadmill. More particularly, the present disclosure relates to a manual treadmill which can be set to an exercise speed.

2. Description of the Related Art

In the field of physical exercise and rehabilitation, treadmills are common exercise apparatuses. Generally, every treadmill has an exercise platform (or a running board) and a continuous belt mounted around the exercise platform for a user walking or running thereon. According to the driving force upon the continuous belt, the treadmill is typically divided into two categories. The former one is a motorized treadmill which is driven by a powered driving force such as an electric motor, and the latter one is a manual treadmill which is driven by a force applied by a user.

Generally speaking, regarding the motorized treadmill, the rotating speed of the continuous belt corresponds to the walking speed or the running speed of a user. This rotating speed of the continuous belt is shown on the console, and will hereinafter be referred to as an "exercise speed", with the commonly used units of kilometer per hour (km/hr) or mile per hour (mile/hr). The exercise speed may be set by the user via inputting an instruction through an inputting apparatus to the motorized treadmill. During a period of time during which exercise is performed, the continuous belt of the motorized treadmill rotates at a set exercise speed with the motorized treadmill controlling the output power of the motorized treadmill's power controlling system to control the rotating speed of the electric motor. The rotating speed of the continuous belt may be accurately controlled by the power controlling system, allowing the user to set a demanding exercise speed and/or a demanding exercise program to exercise for a fixed period of time at a chosen exercise intensity and/or calorie consumption.

Typically, the rotating speed of the continuous belt of a manual treadmill may not be able to be as easily controlled. The rotation of the continuous belt is driven by a user walking or running on the top surface of the continuous belt. By walking or running on the top surface, forces applied to the continuous belt along the top surface are applied with a user's feet continuously. In this case, the forces applied to the continuous belt, and therefore the rotating speed of the continuous belt may be influenced by the user gripping the handrails to apply more or less reactive load to the continuous belt, fast or slow moving speed, and/or large or small stride length of the user. If the manual treadmill includes a concave top surface such as disclosed in U.S. Pat. No. 8,343,016, the position of the top surface where a user steps also affects the rotating speed of the continuous belt. In addition, manual treadmills with resistance adjusting apparatuses are also disclosed. A user could manually set a predetermined resistance according to an individual's physiological condition and/or expected exercise program. For example, the resistance of a treadmill during a walking program is certainly set to be higher than the resistance of a treadmill during a running program. Adjusting the resistance may change the exercise speed while the exercise motions of the user and the exercise force applied by the user remains the same. It is worthy of note that the aforementioned methods are able to change the relative level of the exercise speed to allow the continuous belt to be able to rotate faster or to rotate slower, but these methods do not allow a manual treadmill to set an absolute value of the exercise speed, for instance, setting the exercise speed to be 10 km/hr. Therefore, it is hard for a user to realize the actual exercise intensity and the actual calorie consumption by exercising at a fixed exercise speed on the manual treadmill. Although some manual treadmill could keep sensing and displaying the rotating speed of the continuous belt, it's still difficult to modify an exercise speed to set an exact target exercise speed and/or to keep exercise at the exact target exercise speed by adjusting the motions of the user, the position of the top surface where the user steps on and/or the resistance to motion and so on, and the user would be unable to enjoy and focus on the exercise course.

U.S. Pat. No. 8,007,408 discloses a manual treadmill which helps a user to exercise at a fixed exercise speed. In this disclosure, a control unit of a manual treadmill is disclosed which is designed to adjust the elevation angle of an exercising platform during the course of the exercise to maintain a target speed. The platform includes a continuous belt mounted thereon and an electronic control apparatus in-situ monitoring the rotating speed of the continuous belt while a user is exercising. If the set target exercise speed is faster (or slower) than the current exercise speed, the elevation angle of the exercising platform (the continuous belt) is increased (or decreased) so that the portion of the user's weight upon the continuous belt that applies a driving force to the top surface of the continuous belt is increased (or decreased) in order to speed up (or slow down) the rotating speed of the continuous belt to approach the set target exercise speed. However, changing the elevation angle while exercising may limit the freedom and the selectivity of exercise. In particular, if the elevation angle is the only parameter that is adjusted to control the rotating speed of the continuous belt, a user would be unable to change from a walking program to running program on an exercise surface with the same elevation angle, or to change from a running program to a walking program on an exercise surface with the same elevation angle. Similarly a user would be unable to perform a faster exercise on an exercise surface with a smaller elevation angle, or to perform a slower exercise on an exercise surface with a larger elevation angle.

SUMMARY

The present disclosure is directed to a manual treadmill that is capable of being set to a target exercise speed according to the demand of a user and is capable of being operated at the target exercise speed for the user walking or running thereon.

The present disclosure is directed to a manual treadmill that is capable of being set to a target exercise speed according to the demand of a user and is capable of being operated at the target exercise speed for the user walking or running thereon, wherein when the target exercise speed is changed, the elevation angle of an exercise surface onto which the user is standing or stepping is maintained substantially the same.

According to one aspect of the present disclosure, a manual treadmill is disclosed. The manual treadmill includes a frame; a continuous belt coupled to the frame and adapted for a user walking or running on a top surface thereof to drive the continuous belt rotating around the frame cyclically; a sensing apparatus, sensing a parameter corresponding to a current rotating speed of the continuous belt and producing a corresponding speed signal; an inputting apparatus, producing an indication signal corresponding to an instruction inputted by the user, wherein the instruction includes a target rotating speed of the continuous belt; a control unit, receiving the speed signal to get a current speed value, receiving the indication signal to get a target speed value, and producing a first control signal; and a resistance adjusting apparatus, producing a resistance to impede the rotation of the continuous belt according to the first control signal; wherein the control unit controls the resistance adjusting apparatus to decrease the resistance when the current speed value is lower than the target speed value; the control unit controls the resistance adjusting apparatus to increase the resistance when the current speed value is higher than the target speed value. In the present disclosure, without controlling the rotating speed continuously by the user, the resistance of the continuous belt increases (or decreases) automatically when the current rotating speed of the continuous belt is higher (or lower) than the target rotating speed indication set by the user, and the rotating speed of the continuous belt therefore can decrease (or increase) under the same force to approach the target rotating speed.

According to another aspect of the present disclosure, wherein the control unit repeatedly compares the current speed value and the target speed value, and when the current speed value is lower than the target speed value and the resistance hasn't yet reached a lower limit of available resistance settings, the control unit controls the resistance adjusting apparatus to decrease the resistance; when the current speed value is higher than the target speed value and the resistance hasn't reached an upper limit of available resistance settings, the control unit controls the resistance adjusting apparatus to increase the resistance. Therefore, regardless of the force the user applies to the continuous belt, the rotating speed of the continuous belt is able to be maintained to at a speed that approaches the target rotating speed.

According to another aspect of the present disclosure, wherein the control unit is capable of evaluating a rotating speed of the continuous belt when the resistance has reached its lower limit of available resistance settings, the rotating speed of the continuous belt is evaluated according to the variation correlation between the resistance and the current rotating speed value, and therefore the control unit is capable of changing an upper limit of the rotating speed of the continuous belt accordingly. Therefore, the user has a better exercise experience by realizing the individual's maximum speed one can reach.

According to another aspect of the present disclosure, wherein the frame further includes a fixed portion and a mobile portion; at least a portion of the continuous belt is coupled to the mobile portion so that when a relative position of the mobile portion and the fixed portion is changed, a relative position of the portion the continuous belt coupled to the mobile portion and the fixed portion is changed accordingly; an elevation angle adjusting apparatus coupled between the fixed portion and the mobile portion, capable of changing an elevation angle between the fixed portion and the mobile portion according to a second control signal produced by the control unit. Therefore, the user can exercise on the exercise surface with different elevation angles at a setup speed.

According to another aspect of the present disclosure, wherein the control unit controls the elevation angle adjusting apparatus to increase the elevation angle when the current speed value is lower than the target speed value; the control unit controls the elevation angle adjusting apparatus to decrease the elevation angle when the current speed value is higher than the target speed value. Therefore, in addition to the resistance being able to be changed automatically, the elevation angle also changes automatically to be able to adjust the portion of the force applied to the top surface of the continuous belt in a direction that drives the motion of the continuous belt. By automatically changing the elevation angle to adjust the driving force applied to the continuous belt, the treadmill can adjust the driving force applied to the continuous belt in order to reach the target speed value.

According to another aspect of the present disclosure, when the current speed value is lower than the target speed value, the treadmill control unit first attempts to reduce the resistance to motion of the continuous belt, and when the resistance reaches its lower limit of available resistance settings, the control unit controls the elevation angle adjusting apparatus to increase the elevation angle. Therefore, even when the resistance reaches its lower limit, the exercise speed still can be raised.

According to another aspect of the present disclosure, when the resistance hasn't yet reached its lower limit of available resistance settings, the control unit doesn't attempt to control the speed of the continuous belt by controlling the elevation angle adjusting apparatus, but instead only controls the resistance to adjust the speed of the continuous belt. In other words, unless the target exercise speed can't be reached by only adjusting the resistance, resistance will preferentially be used to adjust the speed of the continuous belt, and the elevation angle will not be changed automatically.

According to another aspect of the present disclosure, wherein the inputting apparatus is capable for the user to input an elevation angle indication signal, and when the control unit receives the elevation angle indication signal, the control unit controls the elevation angle adjusting apparatus to change the elevation angle accordingly. Therefore, the user can exercise on the exercise surface with a selected elevation angle at a specific speed.

According to another aspect of the present disclosure, wherein the inputting apparatus is capable for the user to select one of a plurality of the exercise intensity programs which includes a predetermined elevation angle value and a predetermined speed value; when the control unit receives a signal corresponding to the selection of the user, the control unit controls the elevation angle adjusting apparatus to change the elevation angle according to the predetermined elevation angle value and controls to take the predetermined speed value as the target speed value. Therefore, the user can raise or reduce the exercise intensity rapidly.

According to another aspect of the present disclosure, wherein the control unit is capable of evaluating a rotating speed of the continuous belt when the resistance has reached its lower limit of available resistance settings and the elevation angle reaches an upper limit of available resistance settings according to the variation correlation between the resistance, the elevation angle, and the current speed value, and therefore the control unit is capable of changing an upper limit of the rotating speed of the continuous belt accordingly. Therefore, the user has a better exercise experience by realizing individual's maximum speed one can reach.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
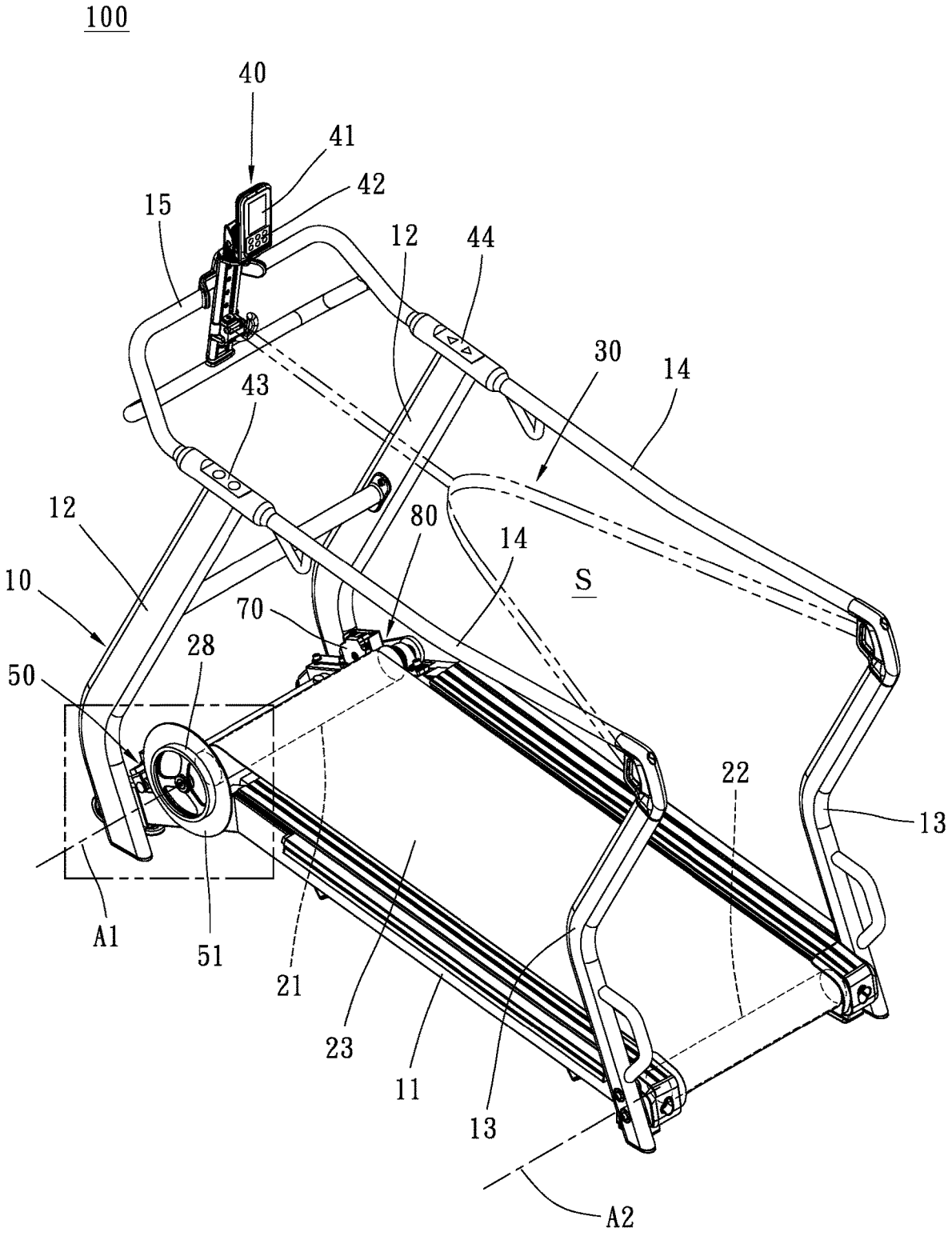
FIG. 1 is a perspective view of a manual treadmill in accordance with a first embodiment of the present disclosure.
Figure 2:
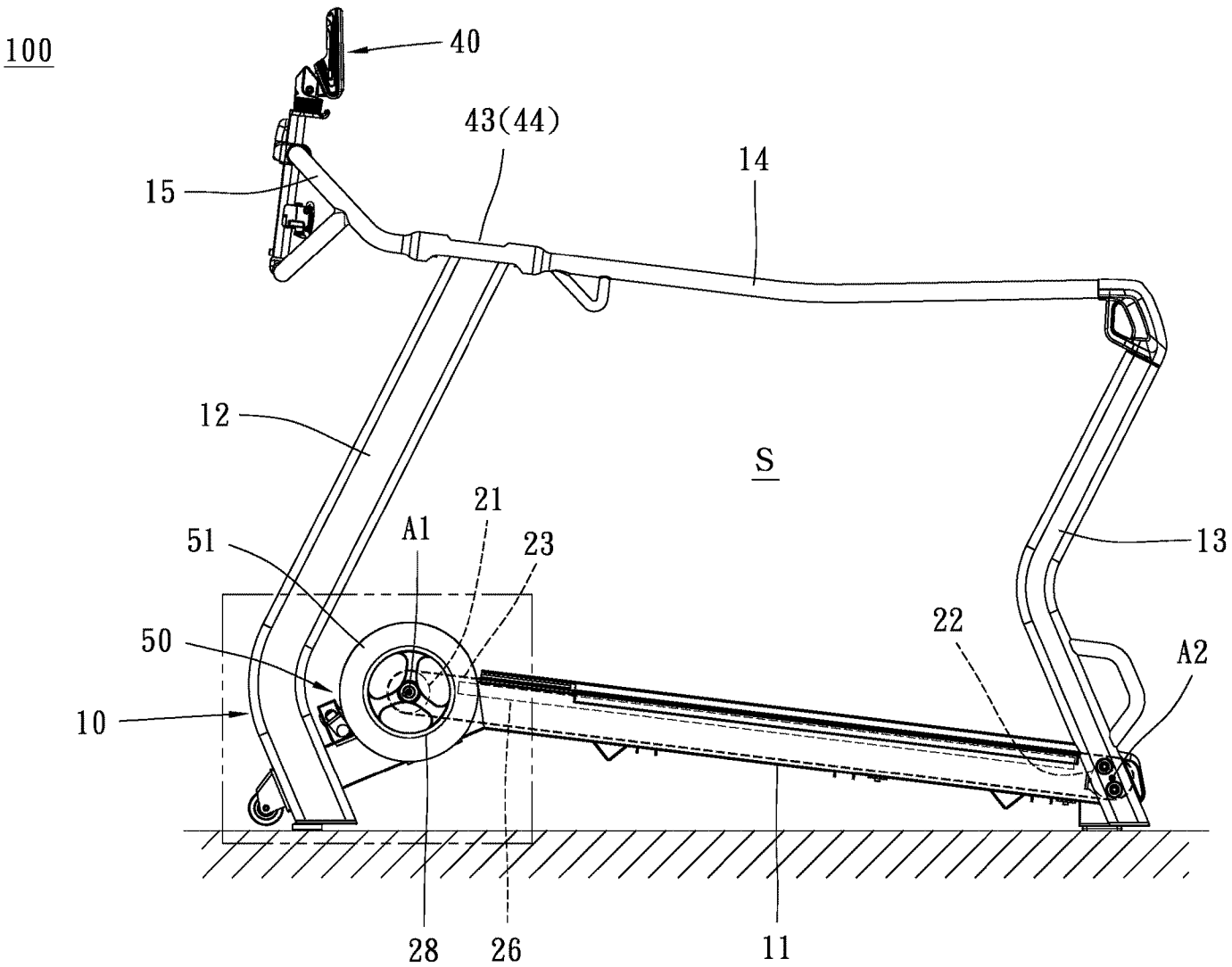
FIG. 2 is a side view of a manual treadmill in accordance with a first embodiment of the present disclosure.

Referring to FIG. 1 and FIG. 2, a manual treadmill 100 is illustrated in accordance with a first embodiment of the present disclosure. The manual treadmill 100 includes a frame 10 which includes a base 11 stably standing on the ground, two front uprights 12 extending upwardly from left and right front sides of the base 11, two back uprights 13 extending upwardly from left and right back sides of the base 11, two side poles 14 respectively connecting to the front uprights 12 and the corresponding back uprights 13, and a front frame 15 connecting between the top portions of the front uprights 12. The base 11 extends as a rectangular shape and has a longer side extending from the front to the back of the manual treadmill 100. An exercise space S is defined on the base 11, and a rear end of the exercise space S includes an entering and leaving portion between the back uprights 13 for a user entering and leaving the exercise space S from the back side of the manual treadmill 100.

The manual treadmill 100 further comprises a front roller 21 and a back roller 22 respectively coupled to a front end and the rear end of the base 11 and rotating about each's self-axis, respectively. The self-axis of the front roller 21 is defined as a first axis A1 and the self-axis of the back roller 22 is defined as a second axis A2, and both extend from the left to the right of the manual treadmill 100. A continuous belt 23 rotates around the front roller 21 and the back roller 22 simultaneously with an adequate tension so that the continuous belt 23 includes a top surface 24 (or a bottom surface) rotating on the base 11 from front to back of the manual treadmill 100 and drives the front roller 21 and the back roller 22 doing in-situ rotations while rotating.

As shown in FIG. 2, the height of the front roller 21 is higher than that of the back roller 22 so that the top surface 24 of the continuous belt 23 is an inclined plane. A user can exercise thereon such as slow walking, fast walking, slow running, fast running, walking backward, running backward, and so on. Under a normal exercise condition, the user exercises by applying a force with the user's feet from the higher front end of the top surface 24 to the lower rear end of the top surface 24 to drive the rotation of the continuous belt 23. A plate 26 is supported by the base 11 and is located under the top surface 24 of the continuous belt 23 to support the weight of the user, and the top surface 24 of the continuous belt 23 is parallel with the top surface of the plate 26 for the user to step thereon.

As shown in FIG. 1, a confining system 30 is optionally set in the exercise space S, and the confining system 30 is substantially a detachable Y shape belt connecting to the front frame 15 and the back uprights 13 and extending on and with an adequate distance away from the continuous belt 23. When a user enters the exercise space S to walk or run, the confining system 30 confines the waist of a user to impede the user further entering the exercise space S so that without needed to grip the side poles 14 or the handrails (a portion of the front frame 15) of the manual treadmill 100, the user still gets a reaction force helping the feet of the user to push the continuous belt 23 rotating backward. The side poles 14, the handrails, and the confining system 30 are optional to the manual treadmill 100. In other words, while exercising without a reaction force, a user still can drive the continuous belt 23 rotating from the higher front end to the lower back end by applying the user's weight upon the inclined top surface 24 of the continuous belt 23, where a portion of this weight applies a normal force to the top surface 24 of the continuous belt 23, and a portion of this weight applies a driving force to the continuous belt 23, here called a dividing force.

A console 40 is set in the middle of the front frame 15 of the frame 10. The console 40 further includes a display apparatus 41 displaying information for a user to observe and a first inputting apparatus 42 for a user to input indication(s). The console 40 in FIG. 1 and FIG. 2 is an illustration, any other type of the displaying system such as a character display, a matrix display, an LCD display, and so on can be adopted individually or collectively to be the display apparatus 41. The first inputting apparatus 42 can include a touch button, a knob, a slider, a driving lever, a touch screen, a contact switch, a non-contact switch, or a combination thereof.

A user can set a target rotating speed of the continuous belt 23 (target exercise speed) by inputting an indication to the first inputting apparatus 42. For example, similar to operating a motorized treadmill, the user indicates a target exercise speed by keying in a target number, touching the number keys, or using a plus key and/or a minus key repeatedly to set a target number, and so on, and then entering the target rotating speed number to the first inputting apparatus 42. Another way to enter a target exercise speed is for the user to select or edit one exercise program by taking advantage of the aforementioned inputting methods, and wherein in the exercise program, the total exercise duration is fixed and the exercise speeds in the duration are changed chronologically. For example, in one exercise program, the total exercise duration is 30 minutes and separated into 15 time slots with the exercise speeds 2, 4, 4, 6, 6, 8, 8, 10, 8, 8, 6, 6, 4, 4, 2 km/hr individually. The first inputting apparatus 42 for the user to input the indication includes either setting a target exercise speed value or selecting an exercise program without knowing the actual exercise speed. As an example, the user may select an exercise program such as "fast walking for 15 minutes", "slow running for 30 minutes" or an exercise intensity program such as "Level 1", "Level 2". In a preferred embodiment, a second inputting apparatus 43 and a third inputting apparatus 44 are respectively mounted on the front uprights 12 of the frame 10 for the user inputting the commonly used exercise program indications. For example, the second inputting apparatus 43 provides a "warm-up" button corresponding to a warm-up program and a "cool-down" button corresponding to a cool-down program, and the third inputting apparatus 44 provides a "+" button corresponding to a speed-up indication and a "–" button corresponding to a slow-down indication. In the following sections, the first inputting apparatus 42, the second inputting apparatus 43, and the third inputting apparatus 44 are collectively called "an inputting apparatus".

While exercising, the display apparatus 41 can keep displaying or displaying intermittently the following information such as the set target exercise speed and/or the exercise program, the current rotating speed of the continuous belt 23 (current exercise speed), the time lapsed, the total exercise distance, the total calories consumed, and so on. The total exercise distance can be calculated by taking advantage of a formula based on the combination of the parameters such as the number of the rotating turns of the front roller 21 or the back roller 22. The total calories consumed can be calculated by taking advantage of a formula based on the combination of the parameters such as the exercise speed, the exercise time lapsed, and the exercise distance, and so on.

Figure 3:
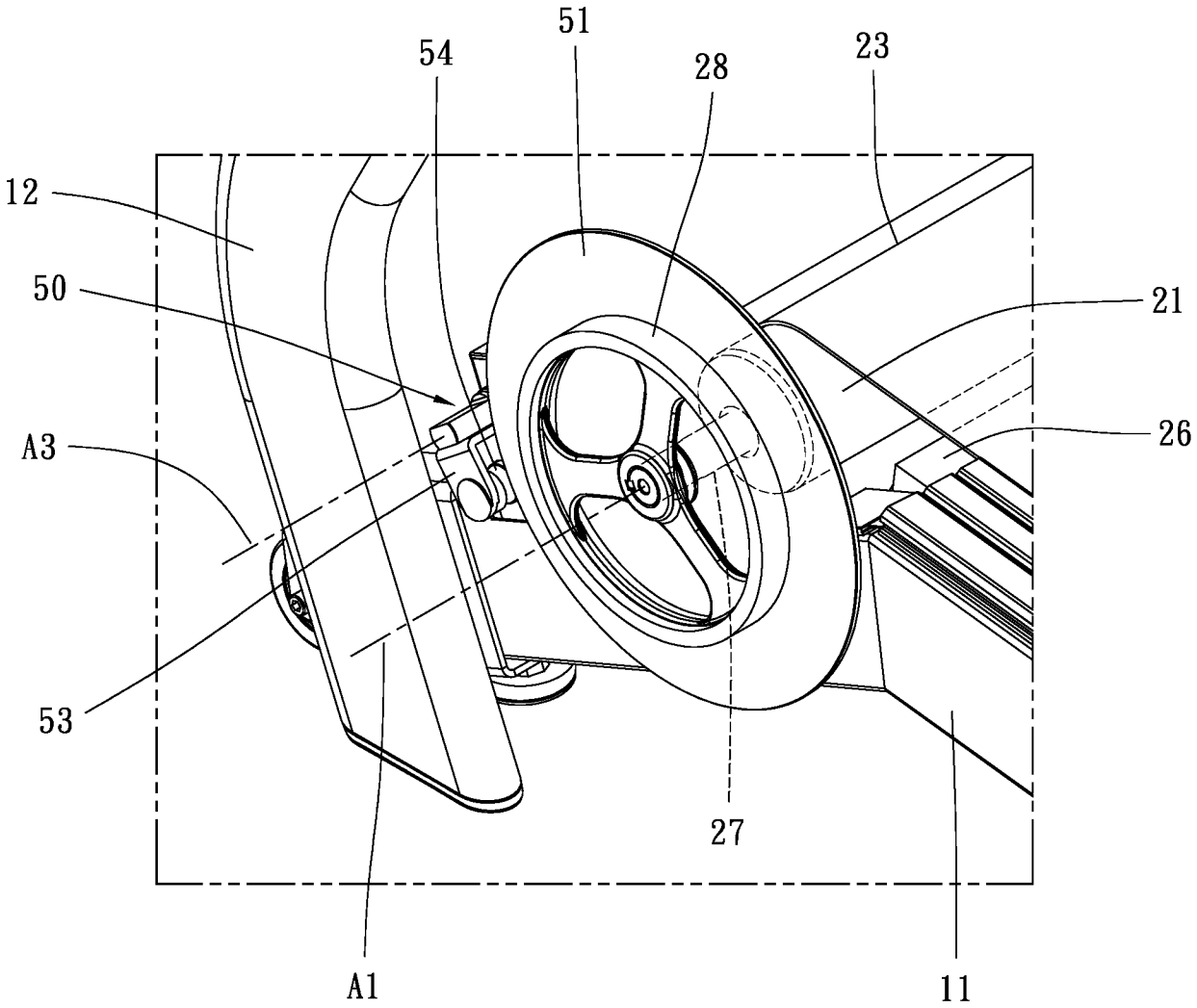
FIG. 3 is a magnified view of the dotted rectangular portion shown in FIG. 1.
Figure 4:
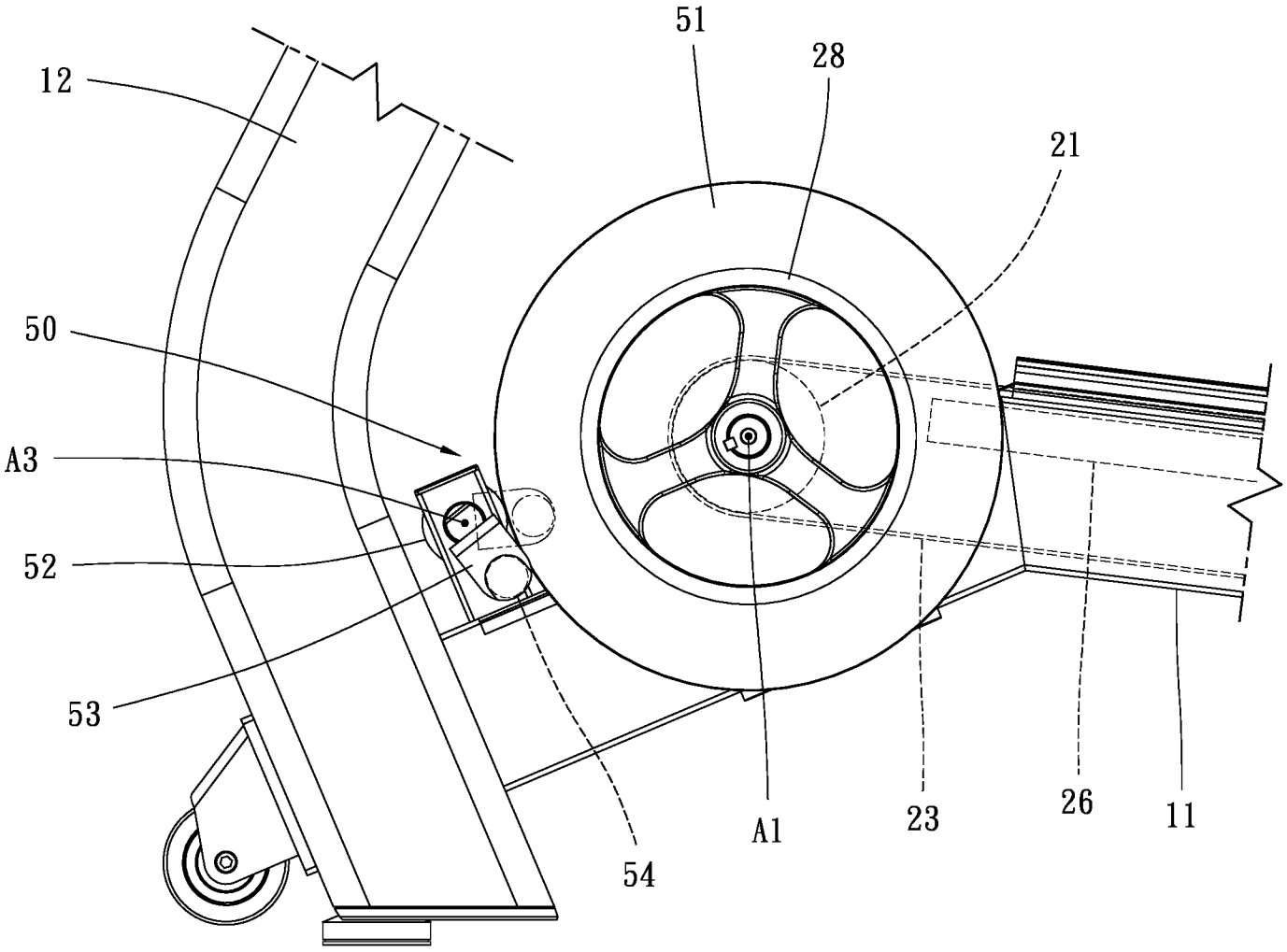
FIG. 4 is a magnified view of the dotted rectangular portion shown in FIG. 2.

Referring to FIG. 3 and FIG. 4, one rotating axis 27 is coaxially extending from a left end of the front roller 21 and one metallic flywheel 28 is coaxially connecting to an outer end of the rotating axis 27 so that the flywheel 28 and the front roller 21 rotate simultaneously to raise the momentum of inertia of the front roller 21. Due to added inertia from the flywheel 28, the continuous belt 23 driven by the front roller 21 rotates more consistently, maintaining a more stable speed.

Figure 5:
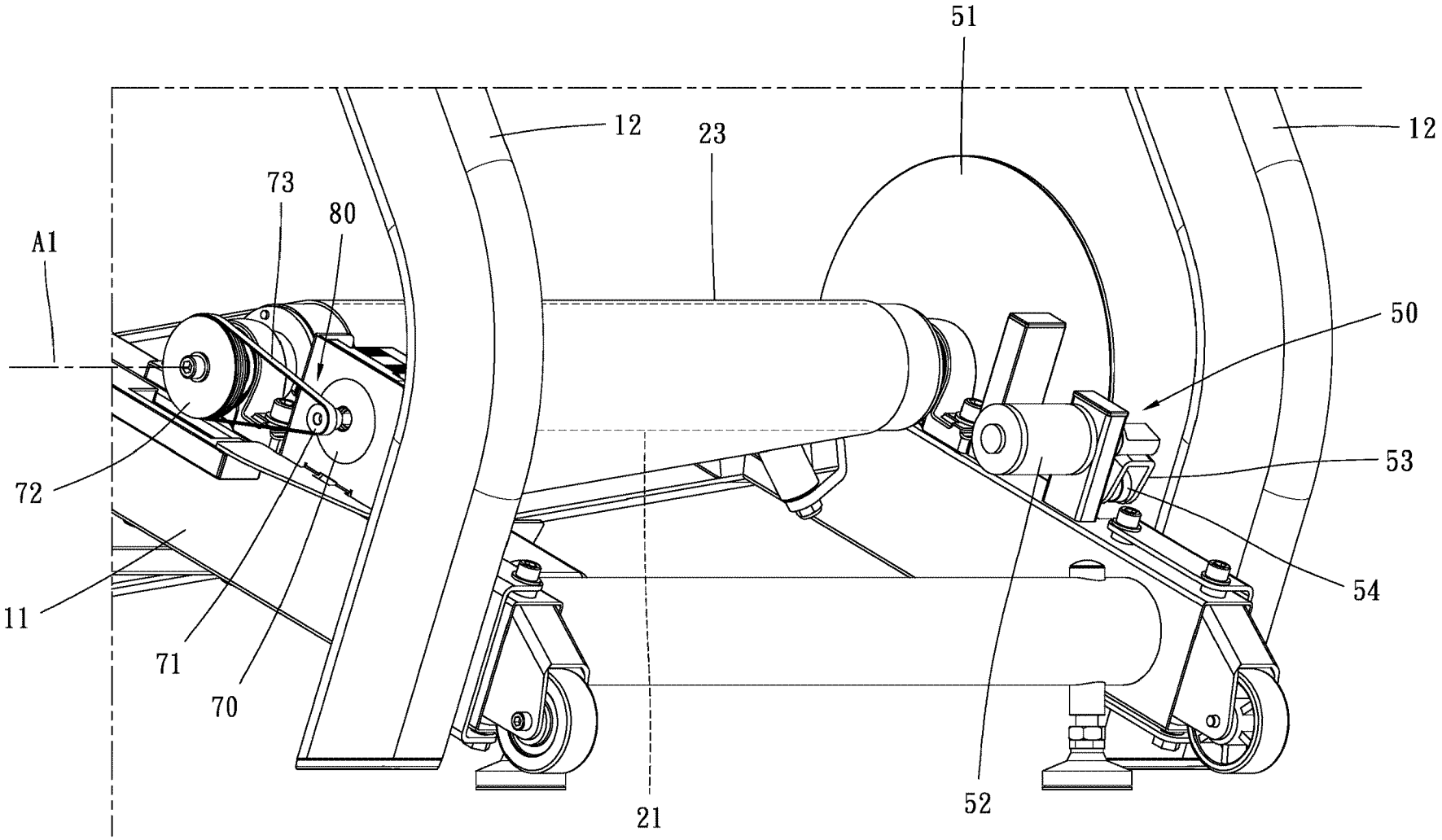
FIG. 5 is a magnified view of a front portion of a manual treadmill in accordance with a first embodiment of the present disclosure.

In FIG. 5, a resistance adjusting apparatus 50 which is used to impede the rotating of the front roller 21 (and the continuous belt 23) is set at the left end of the front roller 21. The resistance adjusting apparatus 50 mainly includes a metallic disc 51, a stepper motor 52, a deflection portion 53, and two permanent magnets 54. The metallic disc 51 is coaxially connected to the rotating axis 27 and doing an in-situ rotation according to the rotation of the front roller 21. The deflection portion 53 is pivotally mounted on the base 11 about a left-right extending third axis A3 (shown in FIG. 4) and is located near a front periphery of the metallic disc 51. The two permanent magnets 54 are respectively mounted on the two corresponding inner surfaces of one U-shape portion of the deflection portion 53 and one extending space is therefore formed between the permanent magnets 54 corresponding to the left-right extending axial thickness of the metallic disc 51. The front periphery of the metallic disc 51 can enter the extending space between the permanent magnets 54. The stepper motor 52 is mounted on the base 11 with a step angle of 0.9 degree and is capable of driving the deflection portion 53 rotating about the third axis A3 in a range of about 60 degrees between an outermost position (solid line) and an innermost position (dotted line) shown in FIG. 4. The deflection portion 53 can be selected to locate at one of the 64 predetermined positions in the 60 degrees including the outermost position and the innermost position. When the deflection portion 53 locates more toward the outermost position (clockwise), from the side view, the overlapping area of the two permanent magnets 54 and the metallic disc 51 is less, and when the deflection portion 53 locates more toward the innermost position (counterclockwise), from the side view, the overlapping area of the two permanent magnets 54 and the metallic disc 51 is more. In this embodiment, the resistance adjusting apparatus 50 is an eddy current brake. When the metallic disc 51 entering the extending space between the two permanent magnets 54, an eddy current resistance is formed between the metallic disc 51 and the two permanent magnets 52. Because of connecting to the metallic disc 51, the rotation of the continuous belt 23 is impeded by the eddy current resistance. Furthermore, the magnitude of the eddy current resistance is changed according to the overlapping area of the two permanent magnets 54 and the metallic disc 51. In the embodiment, because the stepper motor 52 has 64-steps adjustment regarding the locations of the deflection portion 53, the magnitude of the eddy current resistance also has 64 levels.

In addition to the aforementioned eddy current brake, the resistance adjusting apparatus 50 could also be in other forms such as: replacing the permanent magnets by a position fixed electromagnet set so that the magnitude of the eddy current can be adjusted by controlling the magnitude of the current of the electromagnet set; a power generator (DC motor) with a load circuit connecting to the front roller 21 and/or the back roller 22, the rotor of the power generator is driven by the rotation of the front roller 21 and/or the back roller 22, and the magnitude of the resistance can be adjusted by changing the amount of the load through the load circuit; and a contact type resistance producer such as forming friction blocks to replace the permanent magnets 52 and adjusting the rotating resistance of the flywheel 28 by controlling the tightness the friction blocks touching the flywheel 28 through an electric actuator and so on.

Referring to FIG. 5, a power generating apparatus 70 is mounted at the periphery of the right end of the front roller 21 (the left part of FIG. 5). The structure of the power generating apparatus 70 is similar with a DC motor, which includes a rotor (not shown) coaxially connected with its outer end to a small pulley 71. Correspondingly, the right end of the front roller 21 is coaxially connected to a large pulley 72, and a transmission belt 73 connects the small pulley 71 and the large pulley 72. Therefore, while the large pulley 72 is doing an in-situ rotation, the rotor of the power generating apparatus 70 is driven to rotate with a higher speed so that the power generating apparatus 70 starts to provide electric power when the speed is higher than a threshold. The electric power can be stored in a power storing apparatus (not shown) and then be provided to the electronic apparatus of the manual treadmill such as the display apparatus 41, the inputting apparatus 42, 43, 44, the resistance adjusting apparatus 50, and so on while needed. The manual treadmill of the present disclosure can also include other power supplying apparatus and/or an outer power source.

Because the output power of the power generating apparatus 70 is related to the rotating speed of the front roller 21, the rotating speed of the continuous belt 23 can be evaluated depending on the output power and/or the output current of the power generating apparatus 70. In other words, the power generating apparatus 70, the small pulley 71, the large pulley 72, and the transmission belt 73 constitute a sensing apparatus 80 which can sense a current rotating speed of the continuous belt 23.

The sensing apparatus 80 also can be, but is not limited to: a photo sensor, a magnetic sensor, an imaging sensor, and so on. In addition to sensing the rotating speed of the front roller 21, the sensor can also sense the rotation speed of the back roller 22, and/or any other structure which rotates or otherwise moves along with the rotation of the continuous belt 23. In one embodiment, a disc shutter (not shown) rotating along with the rotation of the front pulley 21 is formed, a plurality of equally spaced openings are formed at the outer periphery of the disc shutter, and a photo emitter and a photo receiver are respectively located at the opposite sides of the disc shutter. By counting the times (calculating the frequency) the light passing through the disc shutter, the rotating speed of the disc shutter can be evaluated, and the rotating speed of the continuous belt 23 is obtained. As an example, if the rotation speed ratio of the disc shutter to the front roller 21 is 1:1 and the circumference of the front roller 21 is 25 centimeters, when the rotation speed of the disc shutter is 300 rpm, the rotation speed of the continuous belt 23, 4.5 kilometers per hour, can be evaluated.

Generally speaking, in the present disclosure, the sensing apparatus can sense a parameter corresponding to a current rotation speed of the continuous belt and producing a corresponding speed signal. The corresponding speed signal may be an unprocessed signal (pulse wave signals excited by the photo receiver) and/or a processed signal (analogic signals or digital signals corresponding to the rotation speed).

Figure 6:
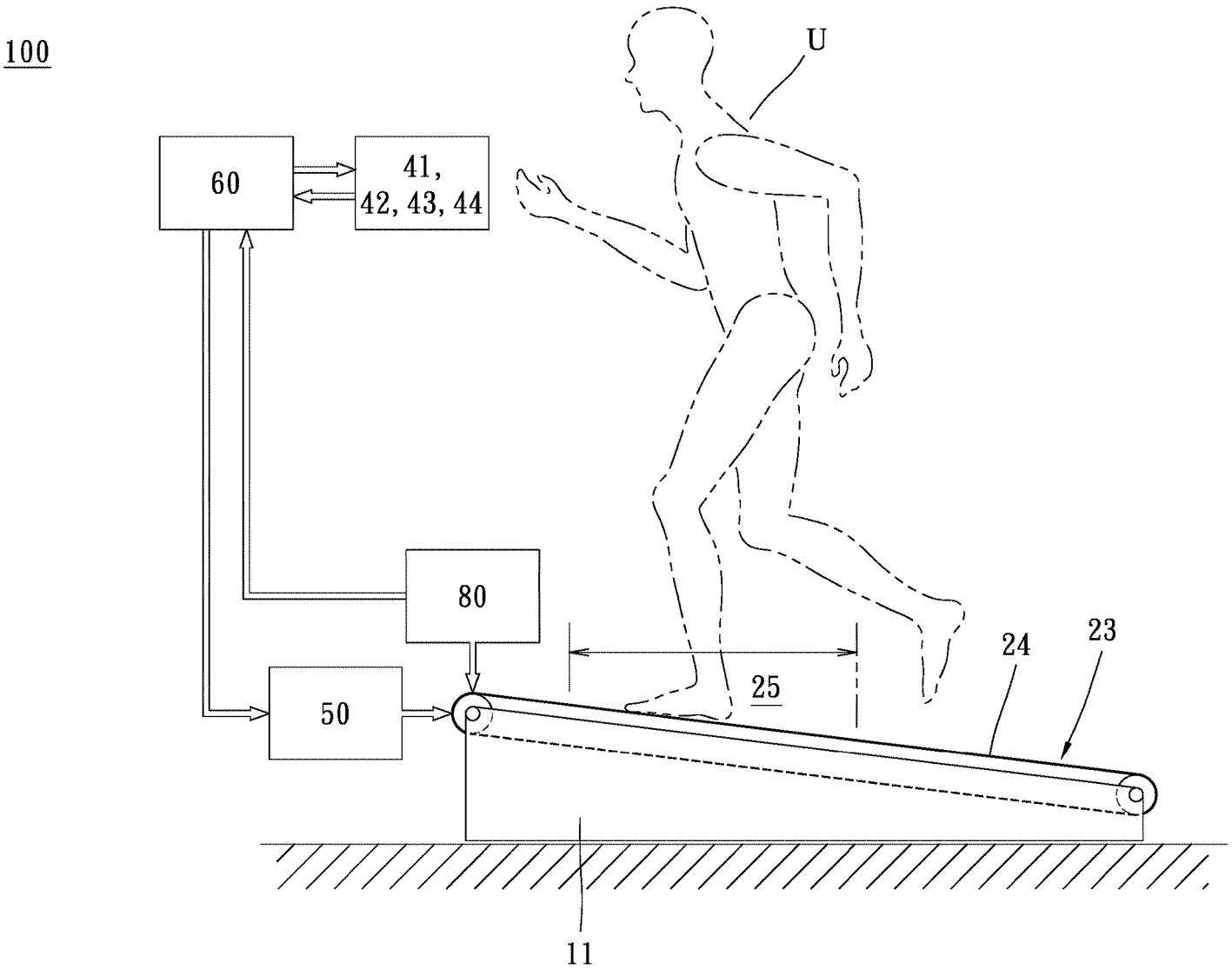
FIG. 6 is an illustration of an exercise speed control mechanism of a manual treadmill in accordance with a first embodiment of the present disclosure.

FIG. 6 discloses an illustration of an exercise speed control mechanism of the manual treadmill 100. A user U walks or runs on the top surface 24 of the continuous belt 23. While exercising, the user U often steps on the treadmill 100 in a predetermined portion, a main force zone 25, of the continuous belt 23. Because the main force zone 25 is an inclined surface that is high in the front and low in the back, a dividing force of the downward force applied by the user U parallel with the inclined surface is therefore formed. The dividing force provides a force from the upper front to the lower back to help the continuous belt 23 rotating accordingly. In other words, the dividing force is the portion of the downward force that drives the inclined top surface 24 of the continuous belt 23 to rotate. Meanwhile, the resistance apparatus 50 provides a resistance to impede the rotation of the continuous belt 23 (and thereby to impede the walking or running of the user), and the sensing apparatus 80 senses the current rotation speed of the continuous belt 23 (current exercise speed).

The manual treadmill 100 further includes a control unit 60. The control unit 60 calculates, judges, and controls according to programmed setting rules. In one embodiment, the control unit 60 including a programmable microprocessor and an accessible memory, both installed in the console 40 and electrically in communication with the display apparatus 41, the inputting apparatus 42, 43, 44, the resistance adjusting apparatus 50, and the sensing apparatus 80. This electronic communication may be wired or wireless. When the user inputs an indication through the inputting apparatus 42, 43, 44, the inputting apparatus 42, 43, 44 produces one corresponding indication signal to the control unit 60. When the corresponding indication signal is directed to a rotation speed of the continuous belt 23, the control unit 60 receives a target speed value (target exercise speed value). The control unit 60 also receives a current speed value (current rotation speed of the continuous belt 23) by receiving the corresponding current speed signal from the sensing apparatus 80. The control unit 60 produces a first control signal to control the resistance adjusting apparatus 50 (driving circuit of the stepper motor 52) in order to change the magnitude of the resistance. The control unit 60 controls the display apparatus 41 to display specific information such as the current speed value, the target speed value, the time lapsed, the total exercise distance, the total calories consumed, and so on. The power source of the control unit 60 can be from the aforementioned power generating apparatus 70, the power storing apparatus, and/or an outside power source such as AC electrical service from an electrical receptacle.

Figure 7:
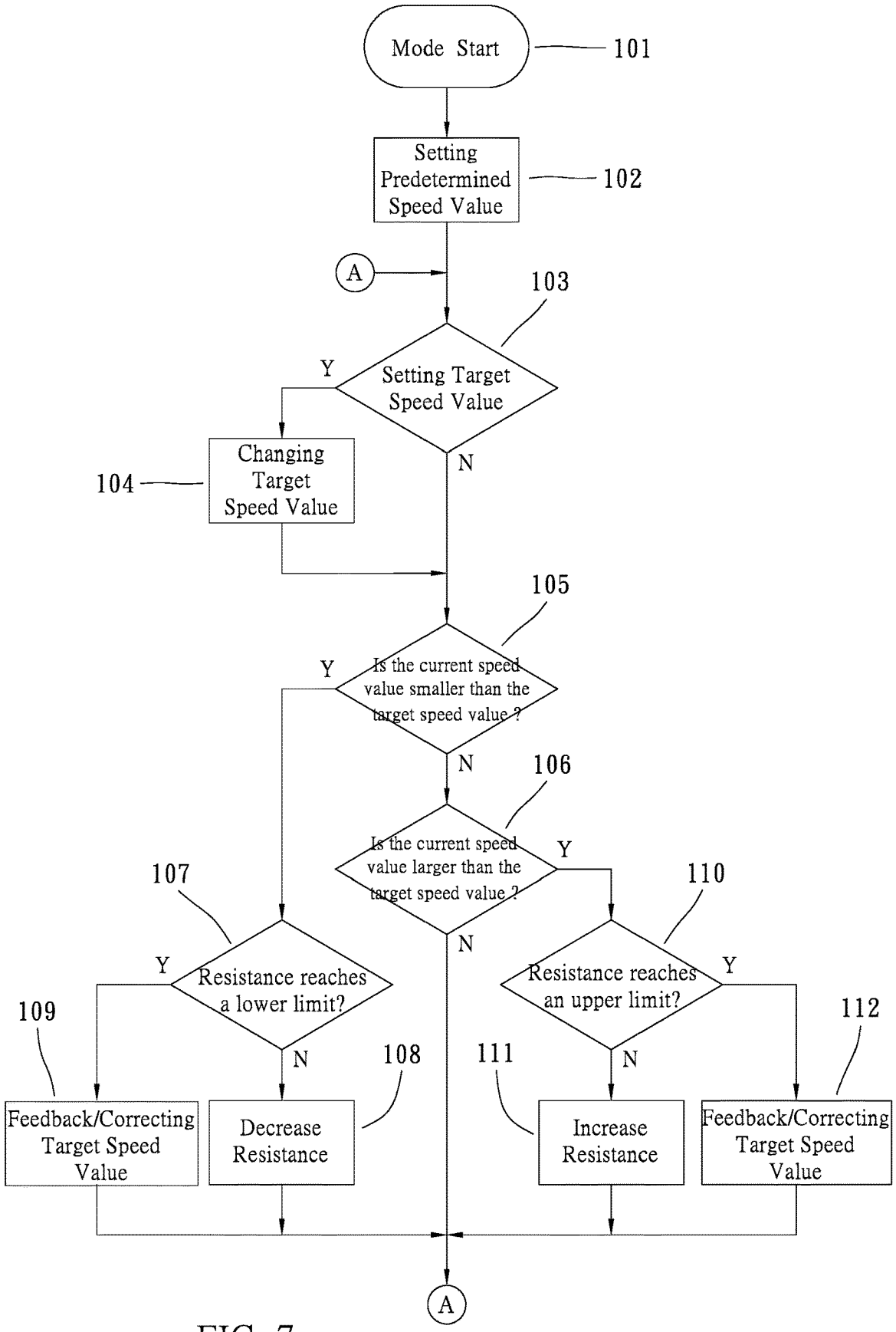
FIG. 7 is a flow chart of a control mode in accordance with a first embodiment of the present disclosure.

FIG. 7 is a flow chart of the manual treadmill's control mode. According to the control mode, the control unit 60 repeatedly compares the current rotation speed of the continuous belt 23 (current speed value) and the target rotating speed of the continuous belt 23 (target speed value). When the current speed value is lower than the target speed value and the resistance hasn't reached a lower limit of available resistance settings, the control unit 60 controls the resistance adjusting apparatus 50 to decrease the resistance. Conversely, when the current speed value is higher than the target speed value and the resistance hasn't reached an upper limit of available resistance settings, the control unit 60 controls the resistance adjusting apparatus 50 to increase the resistance. The following sections describe each procedure in more detail. Wherein the word "Y" shown at the branch means the judgement result is yes, and the word "N" shown at the branch means the judgement result is no.

Procedure 101 is "Mode Start". The control mode can be started either by the control unit 60 after it receives an indication signal from the user through the inputting apparatus 41, 42, 43, or by the control unit 60 automatically according to a predetermined rule. In the latter situation, each time when the manual treadmill 100 receives power, or each time when the manual treadmill 100 is restarted, or each time the control unit 60 judges that a user starts to exercise on the continuous belt 23 according to the variation of the current speed value, the control unit 60 starts the control mode automatically.

Procedure 102 is "Setting Predetermined Speed Value". When the control mode starts, the control unit 60 sets a predetermined speed value in the target speed value to be a temporary target speed value. The predetermined speed value is preferentially set to a slow speed such as 4 km/hr.

Procedure 103 is "Setting Target Speed Value". In this procedure, the control unit 60 judges whether or not it receives any indication signal including setting a target speed value from the inputting apparatus 41, 42, and/or 43, such as the user indicating a specific target speed value, the user indicating to speed up (or to slow down), or the user selecting one specific exercise program.

Procedure 104 is "Changing Target Speed Value". In Procedure 103, if the user is exercising according to the previous predetermined exercise program, the control unit 60 compares the previous predetermined exercise program and the set target speed value to judge if it needs to change the target speed value or not. If the target speed value needs to be changed, it goes to procedure 104, and the control unit 60 changes the target speed value. If the target speed value needs not to be changed, it goes to procedure 105.

Procedure 105 is "Is the current speed value is smaller than the target speed value?". In procedure 105, the control unit 60 compares the current speed value and the target speed value to judge if the current speed value is smaller than the target speed value (or smaller more than a predetermined value such as 0.1 km/hr comparing to the target speed value). If the judgement result is yes (Y), it goes to procedure 107. If the judgement result is no (N), it goes to procedure 106.

Procedure 106 is "Is the current speed value is larger than the target speed value?". In procedure 106, it means the current speed value is not smaller than the target speed value (or not smaller more than a predetermined value comparing to the target speed value), and the control unit 60 further compares the current speed value and the target speed value to judge if the current speed value is larger than the target speed value (or larger more than a predetermined value such as 0.1 km/hr comparing to the target speed value). If the judgement result is yes (Y), it goes to procedure 110. If the judgement result is no (N), it goes back to procedure 103 (104) to judge if it needs to change the target speed value.

Procedure 107 is "Resistance reaches an upper limit?". In procedure 107, it means the current speed value is smaller than the target speed value (or smaller more than a predetermined value comparing to the target speed value), and the control unit 60 further judges whether or not the resistance has reached a lower limit of available resistance settings to judge if the deflection portion 53 is located at the outermost position as shown in FIG. 4. If the judgement result is yes (Y), it goes to procedure 109. If the judgement result is no (N), it goes back to procedure 108.

Procedure 108 is "Decrease Resistance". In procedure 108, the control unit 60 controls the resistance adjusting apparatus 50 to decrease the resistance. In the present embodiment, the control unit 60 controls the deflection portion 53 to deflect toward the outermost position. Then, it goes back to procedure 103 (104) to judge if it needs to change the target speed value.

Correspondingly, procedure 110 is "Resistance reaches an upper limit?". In procedure 110, it means the current speed value is larger than the target speed value (or larger more than a predetermined value comparing to the target speed value), and the control unit 60 further judges if the resistance has reached an upper limit of available resistance settings such as to judge if the deflection portion 53 is located at the innermost position as shown in FIG. 4. If the judgement result is yes (Y), it goes to procedure 112. If the judgement result is no (N), it goes to procedure 111.

Procedure 111 is "Increase Resistance". In procedure 111, the control unit 60 controls the resistance adjusting apparatus 50 to increase the resistance. In the present embodiment, the control unit 60 controls the deflection portion 53 to deflect toward the innermost position. Then, it goes back to procedure 103 (104) to judge if it needs to change the target speed value.

In one embodiment, the control unit 60 keeps controlling to decrease (or increase) the resistance in procedure 108 (or 111), and the continuous belt 23 increases (or decreases) its rotation speed accordingly until the current speed value is equal to the target speed value (or the difference is smaller than a predetermined value) or until the resistance reaches the lower limit (or the upper limit) of available resistance settings before the current speed value is equal to the target speed value. Finally, it changes from procedure 108 (or 111) to procedure 103.

In another embodiment, the control unit 60 controls to decrease (or increase) a predetermined amount (usually a small amount) of resistance. For example, the control unit 60 controls the deflection portion 53 to deflect a step toward the innermost (or outermost) position (0.9 degree). And then, it goes back to procedure 103 (104). In this embodiment, even the difference is large, after cyclically repeating the comparing procedure (procedure 103 (104)) and the controlling procedure (procedure 108 (or 111)), the current speed value reaches the target speed value gradually.

Procedure 109 is "Feedback/Correcting Target Speed Value". In procedure 109, the current rotating speed of the continuous belt 23 (current speed value) is still smaller than the setting indication signal by the user (target speed value), but the resistance has reached the lower limit of available resistance settings. In other words, the rotation speed of the manual treadmill 100 is not able to be increased by decreasing the resistance anymore. In this case, the control unit 60 controls the display apparatus 41 displaying the feedback information such as to state that the exercise speed has reached the upper limit and the control unit 60 corrects the target speed value and the upper limit of the exercise speed that can be set by the user through the inputting apparatus 42, 43, 44 according to the current speed value.

Correspondingly, procedure 112 is also "Feedback/Correcting Target Speed Value". In procedure 112, the current rotating speed of the continuous belt 23 (current speed value) is still larger than the setting speed by the user (target speed value), but the resistance has reached the upper limit of available resistance settings. In other words, the rotation speed of the manual treadmill 100 is not able to be reduced by increasing the resistance anymore. In this case, the control unit 60 controls the display apparatus 41 displaying the feedback information such as to state that the exercise speed has reached the lower limit and the control unit 60 corrects the target speed value and the lower limit of the exercise speed that can be set by the user through the inputting apparatus 42, 43, 44 according to the current speed value.

Theoretically, if other conditions are kept the same, the user with higher weight will obtain both a higher upper limit of the exercise speed and a higher lower limit of the exercise speed. At the beginning, the inputting apparatus 42, 43, 44 is available for the user to set an arbitrarily target speed value in a reasonable scope. For example, both the user weighting 50 kg and the user weighting 100 kg can set the target speed value as 16 km/hr or 0.5 km/hr. However, the lighter user may be too light to make the exercise speed achieving as high as 16 km/hr, and the heavier user may be too heavy to make the exercise speed achieving as low as 0.5 km/hr. Therefore, procedures 109 and 112 are produced to prevent the extreme situations. Through the procedures 109 and 112, the setting range of the upper limit and the lower limit of the exercise speed is corrected during the whole control mode as shown in FIG. 7.

In one embodiment, the control unit 60 automatically evaluates the rotation speed of the continuous belt 23 when the resistance is adjusted to the lower limit (or the upper limit) of available resistance settings according to the variation correlation of the resistance value and the current speed value. In addition, the control unit 60 corrects the setting range of the upper limit and the lower limit of the exercise speed accordingly. Therefore, the user has a better exercise experience on the manual treadmill 100 by realizing the individual achievable upper limit and lower limit of the exercise speed.

According to the description of FIG. 7, when a user walks or runs on the manual treadmill 100 under the control mode, the resistance applied to the continuous belt 23 can be increased (or decreased) automatically if the current speed value is larger (or smaller) than the target speed value, and through this feedback system, the current speed value is adjusted to approach the target speed value. Furthermore, by repeatedly comparing the current speed value and the target speed value and then adjusting the resistance according to the comparing result, even if the user changes the target speed value and/or the force applied to the continuous belt 23 during the exercise, the rotation speed of the continuous belt 23 still keeps approaching the set target speed value.

In addition to the control mode, in one embodiment, the manual treadmill 100 also can be operated under another mode. For example, under another mode, the control unit 60 doesn't adjust the resistance automatically, and the resistance is only adjusted by directly inputting the indication regarding the magnitude of the resistance through the inputting apparatus 42, 43, 44. That is, similar with the conventional manual treadmill, the user walks or runs on the treadmill with a set resistance, and the user also can change the resistance value anytime during the exercise.

In the present embodiment, the continuous belt 23 includes a continuous annular surface by connecting a long belt's two ends. The plate 26 is located under the top surface 24 of the continuous belt 23 to support the user's weight. In the structure, the friction between the continuous belt 23 and the plate 26 forms a portion of the resistance to impede the rotation of the continuous belt 23.

Figure 8:
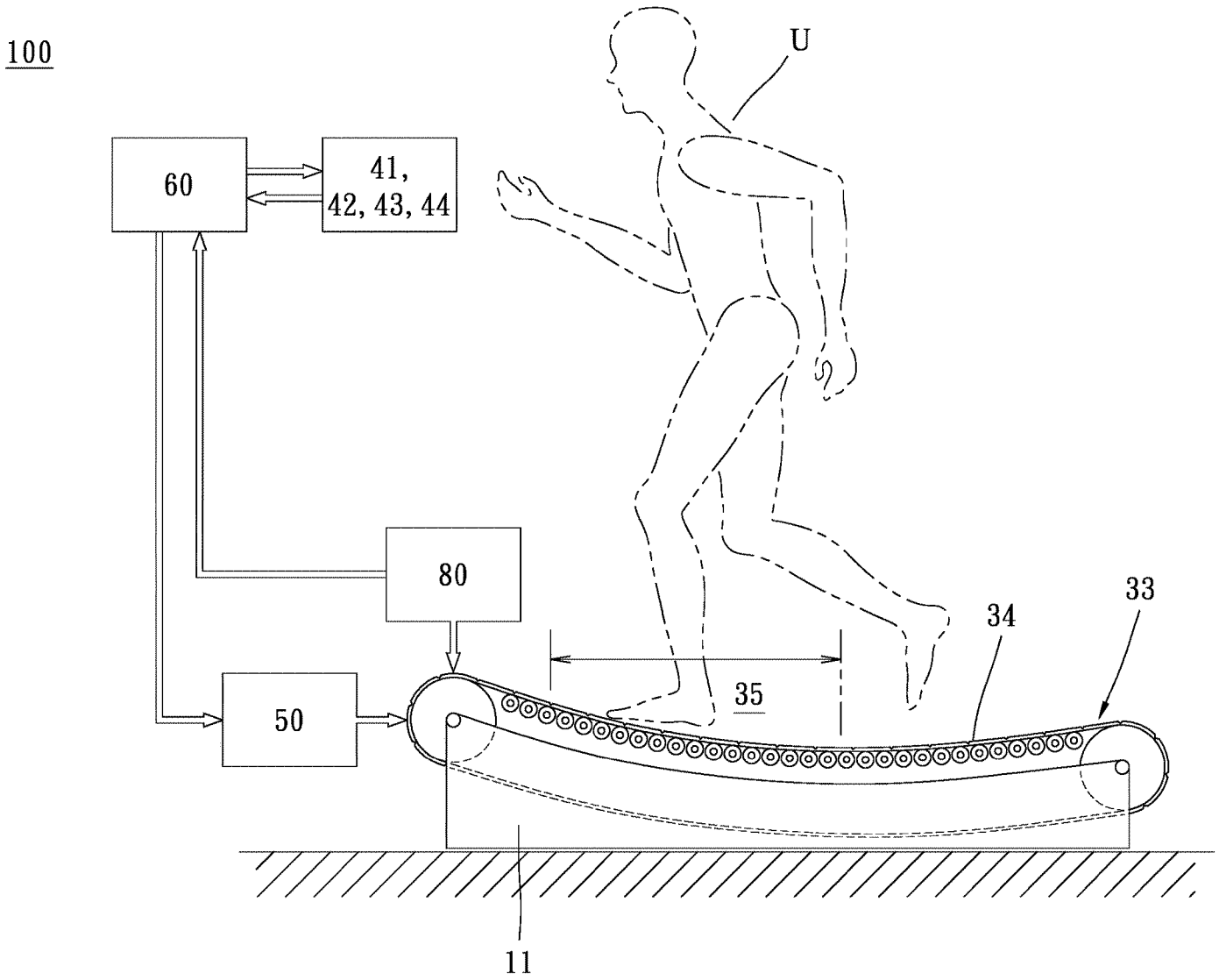
FIG. 8 is an illustration of an exercise speed control mechanism of a manual treadmill similar with FIG. 6 except for comprising a concave top surface.

In another embodiment, the continuous belt is replaced by a slat-belt structure 33 which is formed by connecting a plurality of transversely extending slats with flexible connecting means such as hinges. The slat-belt structure 33 can support the user's weight directly without the need of the plate and therefore the rotation resistance thereof can be decreased. As a design choice, a top surface 34 of the slat-belt structure 33 can be configured into different shapes, including an inclined flat surface as shown in FIG. 6 or a concave surface as shown in FIG. 8. The manual treadmill structure 100 in FIG. 8 is similar to that shown in FIG. 6 except for including a concave top surface 34 formed by the slat-belt structure 33, therefore the drawing numbers used are the same as those shown in FIG. 6 except for the slat-belt structure 33, the concave top surface 34, and a concave main force zone 35. The concave top surface 34 includes a middle portion lower than a front portion and a rear portion thereof. As shown in the figure, while exercising, a user U is stepping on the concave main force zone 35 between the front portion and the middle portion of the concave top surface 34. Similar to the main force zone 25 shown in FIG. 6, the main force zone 35 is high in the front and low in the back. While exercising in the main force zone 35, a dividing force of the downward force applied by the user U parallel with the inclined surface is therefore formed. The dividing force provides a force from the upper front to the lower back to drive the continuous belt 23 rotating accordingly. In this embodiment, because the slope of the top surface 35 is continuously changed, the dividing force is not a constant force to rotate the continuous belt 23. However, by taking advantage of the control mode mechanism mentioned above, the exercise speed can still keep or approach a set target speed value without obvious fluctuations.

Figure 9:
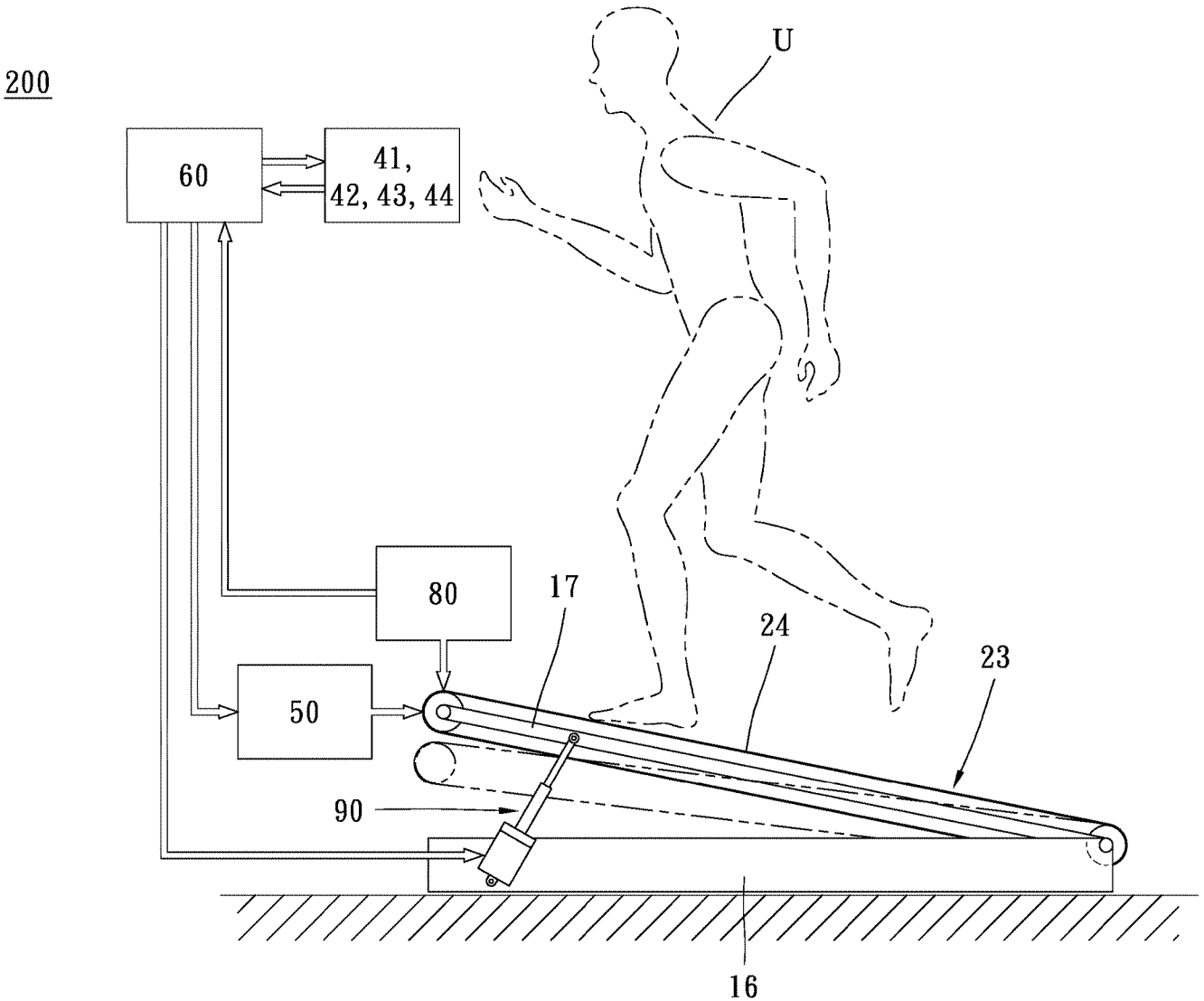
FIG. 9 is an illustration of an exercise speed control mechanism of a manual treadmill in accordance with a second embodiment of the present disclosure.

FIG. 9 shows an illustration of an exercise speed control mechanism of a manual treadmill 200 in accordance with a second embodiment of the present disclosure. Comparing to the treadmill 100 shown in FIG. 6 and FIG. 8, the main difference of the manual treadmill 200 is that the frame includes a fixed portion 16 supported by the ground and a mobile portion 17 which is capable of changing its relative position to the fixed portion 16. In this embodiment, the mobile portion 17 is pivotally connected to the fixed portion 16 about a transversely extending axis such that the mobile portion 17 is capable rotated with its rear end about the transversely extending axis. A continuous belt 23 is rotatably mounted on the mobile portion 17 includes a top surface 24 extending from a higher front portion to a lower rear portion. When the mobile portion 17 is rotated about its rear end, an elevation angle between an imaginary line extending from the front portion to the rear portion (the top surface 24) and the substantially horizontal ground is changed accordingly (relative to the fixed portion 16). An elevation angle adjusting apparatus 90 is mounted between the fixed portion 16 and the mobile portion 17 and includes an incline motor (not shown) which is designed to drive the mobile portion 17, changing its position relative to the fixed portion 16 such that in the present embodiment, the incline motor drives the front portion of the mobile portion 17 to position it vertically up or down relative to its rear end. By rotating the front portion of the mobile portion 17 about an axis at the rear end of the mobile portion 17, an incline angle for the mobile portion 17 can be set anywhere within a predetermined angle range. A control unit 60 drives the vertical position of the mobile portion 17 by controlling the elevation angle adjusting apparatus 90 with a second control signal. That is, the control unit 60 increases or decreases the elevation angle between the mobile portion 17 and the fixed portion 16.

In another embodiment, only a portion of the continuous belt 23 is mounted to the mobile portion 17. For example, only the front end of the continuous belt 23 is supported by the front roller of the mobile portion 17 and the rear end of the continuous belt 23 is supported by the back roller of the mobile portion 17. Therefore, when the relative position of the mobile portion 17 and the fixed portion 16 is changed, the relative position of the portion the continuous belt 23 coupled to the mobile portion 17 and the fixed portion 16 is changed accordingly.

In the second embodiment, the manual treadmill 200 also includes a display apparatus 41, an inputting apparatus 42, 43, 44, a resistance adjusting apparatus 50, and a sensing apparatus 80, and all the apparatuses include similar structures and functions with the previous embodiment.

Figure 10A:
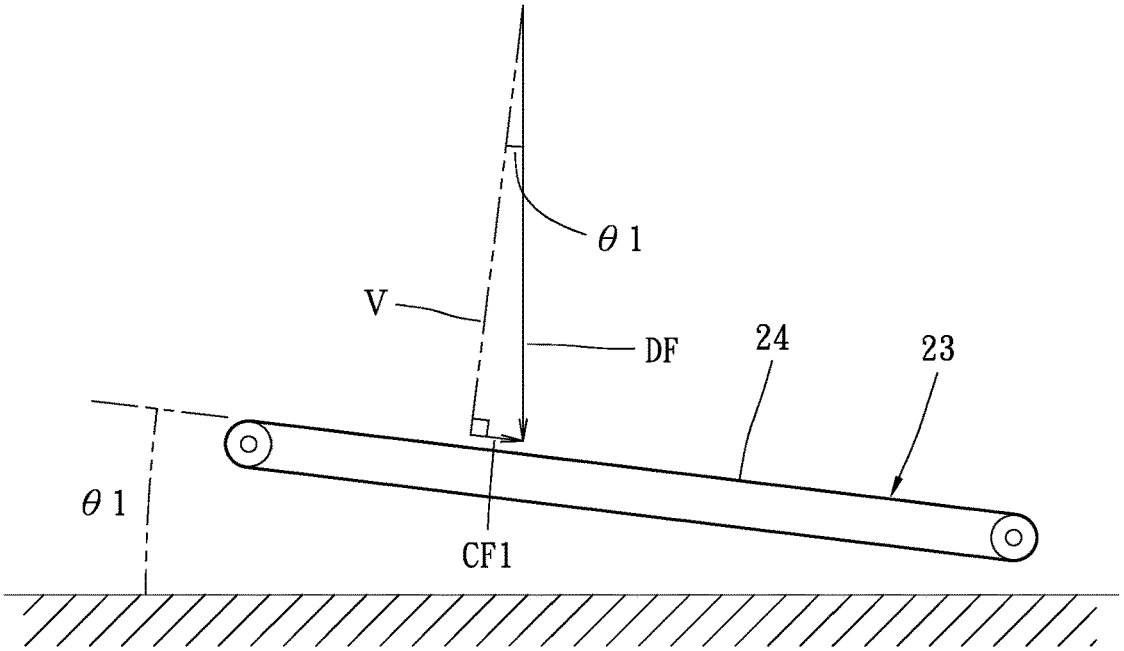
FIGS. 10A and 10B are the schematic views of the frame of the manual treadmill shown at a first elevation angle and at a second elevation angle in accordance with a second embodiment of the present disclosure.
Figure 10B:
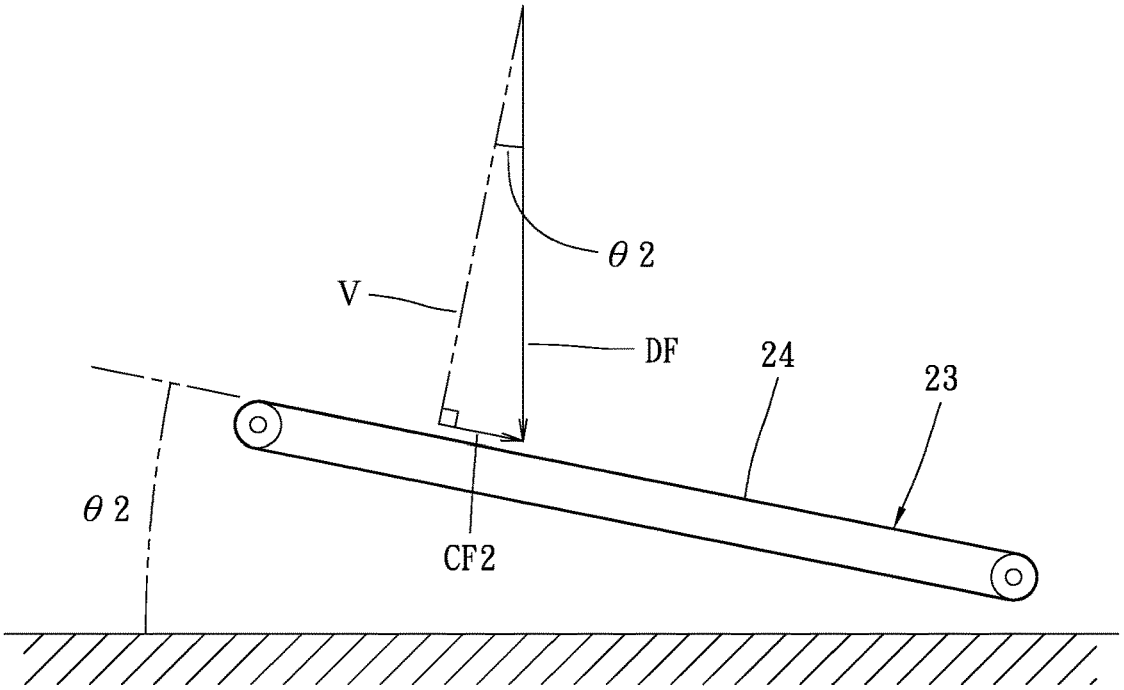

FIGS. 10A and 10B respectively illustrate schematic views when the top surface 24 of the continuous belt 23 located with a first elevation angle θ1 and with a second elevation angle θ2 relative to the ground. In each of the figures, the continuous belt 23 endures a downward force DF. In more detail, when a user U applies a downward force DF such as the user's weight as shown in FIG. 10A, there is a smaller dividing force CF1 in the direction parallel with the top surface 24 corresponding to the smaller first elevation angle θ1. When a user U applies a downward force DF such as the user's weight as shown in FIG. 10B, there is a larger dividing force CF2 in the direction parallel with the top surface 24 corresponding to the larger second elevation angle θ2. That is, if other conditions are maintained, when the elevation angle of the top surface 24 is smaller (or larger), the dividing force applied by the user from the front to the back along the top surface 24 is smaller (or larger), and the rotation speed of the continuous belt 23 is therefore slower (or faster).

Although the top surfaces 24 shown in FIGS. 9, 10A, and 10B are inclined surfaces, in another embodiment, a concave top surface 34 as disclosed in FIG. 8 can also be applied. No matter what the configuration of the top surface is, when the continuous belt 23 or a portion of the continuous belt 23 moves along with the mobile portion 17, the main force zone 25 (35) of the top surface 24 (34) changes its elevation angle accordingly. If the elevation angle is larger (or smaller), the ratio the force applied to drive the continuous belt 23 is larger (or smaller).

Figure 11:
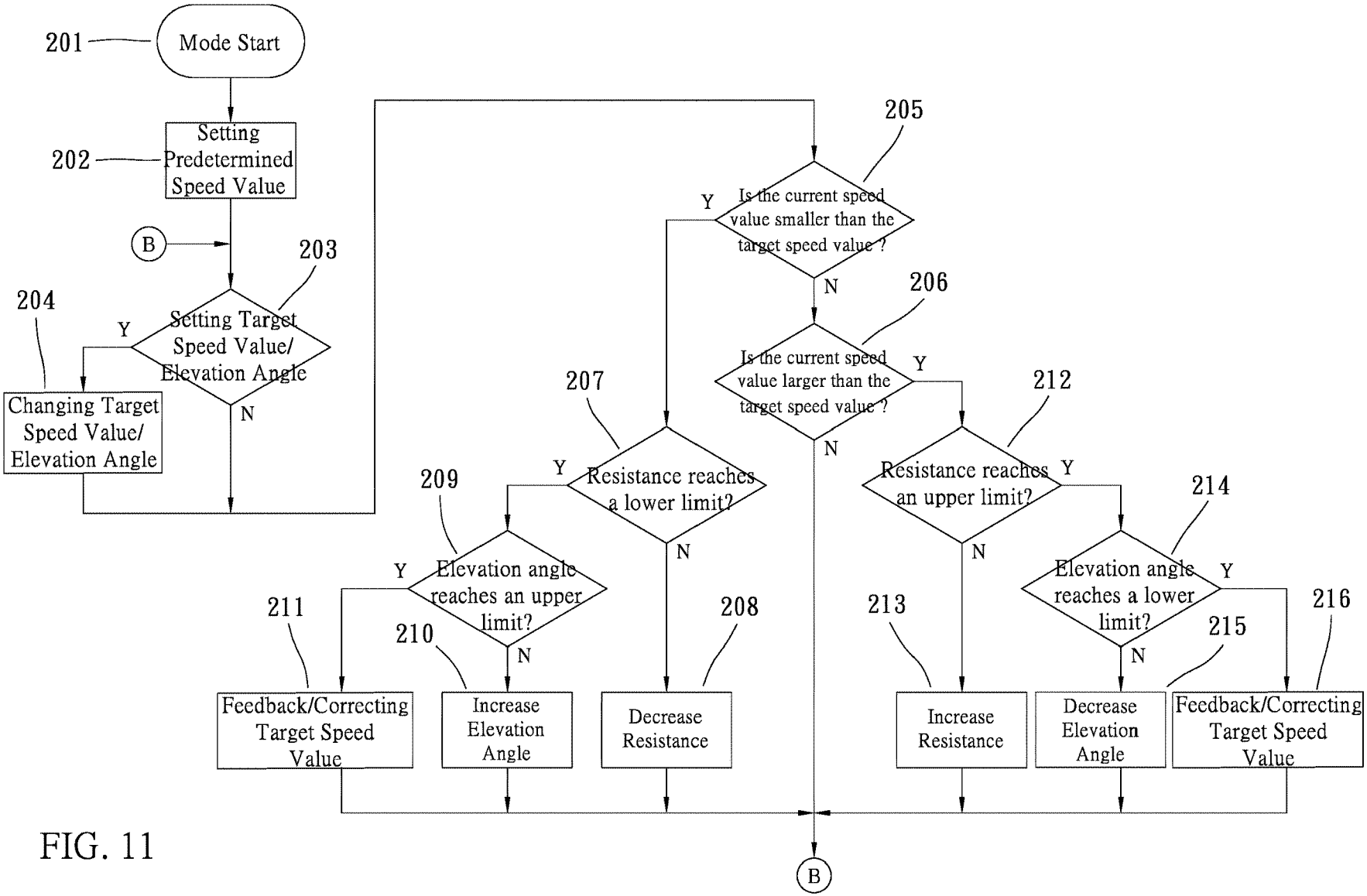
FIG. 11 is a flow chart of a control mode in accordance with a second embodiment of the present disclosure.

FIG. 11 is a flow chart of the manual treadmill's control mode in accordance with the second embodiment. In this control mode, similar with the control mode mentioned in FIG. 7, the control unit 60 is repeatedly comparing a current speed value and a target speed value wherein the definitions thereof are similar with those in the first embodiment. Every time when the current speed value is smaller (or larger) than the target speed value and the resistance hasn't yet reached a lower limit (or an upper limit) of available resistance settings, the control unit 60 controls the resistance adjusting apparatus 50 to decrease (or increase) the resistance. On the contrary, every time when the current speed value is smaller (or larger) than the target speed value and the resistance has reached the lower limit (or the upper limit) of available resistance settings, the control unit 60 controls the elevation angle adjusting apparatus 90 to increase (or decrease) the elevation angle. The procedures 201~208, 212, and 213, are similar with the procedures 101~108, 110, and 111 described in FIG. 7 and are not described again.

If the procedure changes from 207 to 209, it means the current rotation speed of the continuous belt 23 (current speed value) is smaller than the target speed value which is set by the user, and the resistance of the continuous belt 23 has reached the lower limit of available resistance settings. In procedure 209, the control unit 60 identifies if the elevation angle has reached an upper limit of available resistance settings or not. If the answer is yes (Y), the procedure goes from 209 to 211, and if the answer is no (N), the procedure goes from 209 to 210. In procedure 210, the control unit 60 controls the elevation angle adjusting apparatus 90 to increase the elevation angle and then goes back to procedure 203 (204) to judge if it needs to change the target speed value.

Similarly, if the procedure changes from 212 to 214, it means the current rotation speed of the continuous belt 23 (current speed value) is larger than the target speed value which is set by the user, and the resistance of the continuous belt 23 has reached the upper limit of available resistance settings. In procedure 214, the control unit 60 identifies if the elevation angle has reached the lower limit of the adjustable scope or not. If the answer is yes (Y), the procedure goes from 214 to 216; and if the answer is no (N), the procedure goes from 214 to 215. In procedure 215, the control unit 60 controls the elevation angle adjusting apparatus 90 to decrease the elevation angle and then goes back to procedure 203 (204) to judge if it needs to change the target speed value.

There are two methods for the control unit 60 to increase the elevation angle in procedure 210 and to decrease the elevation angle in procedure 215. In one embodiment, the control unit 60 keeps increasing (or decreasing) the elevation angle in procedure 210/215 such that the rotation speed of the continuous belt 23 keeps becoming larger (or smaller) because the dividing force keeps becoming larger (or smaller) until the current speed value is equal to the target speed value (or the difference is smaller than a predetermined value) or until the elevation angle reaches the lower limit (or the upper limit) of the adjustable scope before the current speed value is equal to the target speed value. Finally, the procedure changes from procedure 210 (or 215) to procedure 203 (204). In another embodiment, the control unit 60 controls to decrease (increase) a predetermined amount (usually a small amount) of elevation angle. And then, the procedure goes back to procedure 203 (204). In this embodiment, even the difference is large, after cyclically repeating the comparing procedure (procedure 203 (204)) and the controlling procedure (procedure 210 (or 215)), the current speed value reaches the target speed value gradually.

If the procedure changes from 209 to 211, it means the current rotation speed of the continuous belt 23 (current speed value) is smaller than the target speed value which is set by the user, the resistance of the continuous belt 23 has reached the lower limit of available resistance settings, and the elevation angle has reached the upper limit of the adjustable scope. In other words, the exercise speed can't be increased by decreasing the resistance and/or increasing the elevation angle. Meanwhile, the control unit 60 controls the display apparatus 41 displaying the feedback information such that the exercise speed has reached the upper limit and corrects the target speed value and the upper limit of the exercise speed that can be set by the user through the inputting apparatus 42, 43, 44 according to the current speed value.

Similarly, if the procedure changes from 214 to 216, it means the current rotation speed of the continuous belt 23 (current speed value) is larger than the target speed value which is set by the user, the resistance of the continuous belt 23 has reached the upper limit of available resistance settings, and elevation angle has reached the lower limit of the adjustable scope. In other words, the exercise speed can't be decreased by increasing the resistance and/or decreasing the elevation angle. Meanwhile, the control unit 60 controls the display apparatus 41 displaying the feedback information such as that the exercise speed has reached the lower limit and corrects the target speed value and the lower limit of the exercise speed that can be set by the user through the inputting apparatus 42, 43, 44 according to the current speed value.

In procedure 203, in addition to judge if it needs to change the target speed value or not, the control unit 60 also judges if it receives any elevation angle indication signal including setting an elevation angle from the inputting apparatus 41, 42, and/or 43 or not. If the control unit 60 receives an elevation angle indication signal regarding setting an elevation angle, the procedure goes to 204 first, and the control unit 60 controls the elevation angle adjusting apparatus 90 to match the elevation angle indication signal, and then the procedure goes to 205. On the other hand, if it doesn't need to change the target speed value and the control unit 60 doesn't receive any elevation angle indication signal regarding setting an elevation angle, it goes to procedure 205 directly.

In one embodiment, during the aforementioned control mode, the control unit 60 automatically evaluates the rotation speed of the continuous belt 23 when the resistance is adjusted to the lower limit (or the upper limit) of available resistance settings and the elevation angle is adjusted to the upper limit (or the lower limit) of the adjustable scope according to the variation correlation of the resistance value, the elevation angle, and the current speed value. The control unit 60 corrects the setting range of the upper limit and the lower limit of the exercise speed accordingly. Therefore, the user has a better exercise experience on the manual treadmill 200 by realizing the individual achievable upper limit and lower limit of the exercise speed.

According to the description of FIG. 11 aforementioned, when a user walks or runs on the manual treadmill 200 under the control mode, the elevation angle of the top surface 24 and the resistance applied to the continuous belt 23 can be increased (or decreased) automatically if the current speed value is larger (or smaller) than the target speed value, and the current speed value finally approaches the target speed value. Furthermore, by repeatedly comparing the current speed value and the target speed value and then adjusting the resistance according to the comparing result, even the user changes the target speed value, and/or the elevation angle, and/or the force applied to the continuous belt 23, the rotation speed of the continuous belt 23 still keeps approaching the set target speed value.

Under the control mode, although the elevation angle will be changed automatically according to the comparing result, the control unit doesn't control the elevation angle adjusting apparatus to change the elevation angle if the resistance doesn't reach the lower (or upper) limit of the adjustable scope. That is, according to this control mode, in most situations, the user approximately walks or runs on the treadmill with a predetermined fixed elevation angle.

In addition to the control mode aforementioned, in one embodiment, the manual treadmill 200 also can be operated under another mode. For example, under another mode, the control unit 60 neither adjusts the elevation angle nor adjusts the resistance automatically, and the elevation angle and the resistance are adjusted only by directly inputting the indication regarding the magnitude of the elevation angle and the magnitude of the resistance through the inputting apparatus 42, 43, 44. That is, similar with the conventional manual treadmill, the user walks or runs on the treadmill with predetermined fixed elevation angle and resistance, and the user also can change the elevation angle and the resistance value anytime during the exercise.

In one embodiment, the user can only set the target speed value but not the elevation angle and resistance under another mode. That is, the control unit 60 aims only on matching the set target speed value and then the control unit 60 adjusts the resistance and the elevation angle accordingly. Therefore, at the same time (or under the same procedure), the control unit adjusts either one of the elevation angle and the resistance or both of the elevation angle and the resistance.

In another embodiment, the user can select one of a plurality of the exercise intensity programs which comprises a predetermined elevation angle value and a predetermined speed value through the inputting apparatus 42, 43, 44. When the control unit 60 receives a signal corresponding to the selection of the user, the control unit 60 controls the elevation angle adjusting apparatus 90 to change the elevation angle according to the predetermined elevation angle value and to take the predetermined speed value as the target speed value. Accordingly, the user can rapidly raise or reduce the total exercise intensity.

For the usage convenience, in one embodiment, if the control unit 60 judges that there is no user exercising on the treadmill such that the control unit 60 receives no speed signal or the speed signal keeps zero for a predetermined period of time, the control unit 60 controls the resistance adjusting apparatus 90 to produce a max resistance and/or controls a brake apparatus (not shown) to produce a brake resistance. The max resistance and the brake resistance can make a user stay still on the continuous belt 23 (33) of the manual treadmill 100 (200). That is, the rotation resistance is larger than the dividing force the user applied to the continuous belt 23 (33) to drive the rotation thereof. And then, when the control unit 60 receives an indication signal regarding starting exercise from the inputting apparatus 42, 43, 44, the control unit 60 controls the display apparatus 41 to display a start reminding information for the user and controls the resistance adjusting apparatus 90 and/or the brake apparatus to reduce the resistance to a level that the continuous belt 23 (33) can rotate when the user steps thereon after a predetermined period of time thereafter.

The structure and the adjusting mechanism of the brake apparatus are similar with the aforementioned resistance adjusting apparatus. For example, the user starts the exercise by inputting a start indication signal through the inputting apparatus such as pushing a "start" or a "go" material button (or virtual button) or pushing a "confirm" or a "ok" material button (or virtual button) after setting the target exercise speed or selecting an exercise intensity program.

In another embodiment, if the control unit 60 receives a stop indication signal from the inputting apparatus or if the previous selected exercise program finishes, the control unit controls the resistance adjusting apparatus and/or the brake apparatus to produce an adequate amount of resistance to stop the continuous belt in a predetermined period of time (usually a small period of time). For example, the user stops the exercise by inputting the stop indication signal through the inputting apparatus such as pushing a "pause", a "stop", or an "E-stop" material button (or virtual button), or the user stops the manual treadmill by taking advantage of a safety-clip apparatus. The safety-clip apparatus includes a rope including one front end connected to a magnet or a plug which is detachably attached to a checking structure on the manual treadmill and one rear end connected to a clip clipping to the clothes of the user. When the user stops exercising and leaves the treadmill, the front end of the safety-clip apparatus detaches from the checking structure along with the rope, and a stop indication signal is produced and transmitted to the control unit so that the control unit controls to stop the manual treadmill accordingly.

Overall, the present disclosure is directed to a manual treadmill that is capable of being set at a target exercise speed according to the demand of a user and is capable of being operated at the target exercise speed for the user walking or running thereon. Wherein when the target exercise speed is changed, the elevation angle of an exercise surface which the user steps on (the top surface of the continuous belt) keeps substantially the same or keeps as possible as it can be. The present disclosure is directed to a manual treadmill that is capable of being set at a target exercise speed and an elevation angle of the exercise surface according to the demand of a user and is capable of being operated at the target exercise speed and the specific elevation angle for the user walking or running thereon.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims and their equivalents.

What is claimed is:

1. A manual treadmill, comprising:

a frame having a fixed portion and a mobile portion, a position of the mobile portion being changeable relative to the fixed portion;

a continuous belt coupled to the mobile portion of the frame for a user walking or running on a top surface thereof to drive the continuous belt rotating around the mobile portion of the frame cyclically;

a sensing apparatus, sensing a parameter corresponding to a current rotating speed of the continuous belt and generating a corresponding speed signal;

an inputting apparatus, generating an indication signal corresponding to one or more indications inputted by the user, wherein at least one indication comprises a target rotating speed of the continuous belt;

a resistance adjusting apparatus, generating a resistance to impede the rotation of the continuous belt;

an elevation angle adjusting apparatus mounted between the fixed portion and the mobile portion for changing an elevation angle of the mobile portion relative to the fixed portion; and a control unit, receiving the corresponding speed signal to get a current speed value and receiving the indication signal to get a target speed value, the control unit configured for generating a first control signal for controlling the resistance adjusting apparatus and a second control signal for controlling the elevation angle adjusting apparatus;

wherein the control unit controls the resistance adjusting apparatus via the first control signal to decrease the resistance when the current speed value is lower than the target speed value and to increase the resistance when the current speed value is higher than the target speed value;

wherein when the current speed value is lower than the target speed value and the resistance has reached a lower limit of available resistance settings, the control unit controls the elevation angle adjusting apparatus to increase the elevation angle via the second control signal.

2. The manual treadmill of claim 1, wherein the control unit repeatedly compares the current speed value and the target speed value, and when the current speed value is lower than the target speed value and the resistance hasn't yet reached a lower limit of available resistance settings, the control unit controls the resistance adjusting apparatus to decrease the resistance; when the current speed value is higher than the target speed value and the resistance has not yet reached its highest limit of available resistance settings, the control unit controls the resistance adjusting apparatus to increase the resistance.

3. The manual treadmill of claim 1, wherein the control unit is capable of evaluating a rotating speed of the continuous belt when the resistance reaches a lower limit of available resistance settings, the rotating speed of the continuous belt is evaluated according to a variation correlation between the resistance and the current speed value, and therefore the control unit is capable of changing an upper limit of the rotating speed of the continuous belt accordingly.

4. The manual treadmill of claim 1, wherein the control unit controls the elevation angle adjusting apparatus to increase the elevation angle when the current speed value is lower than the target speed value; the control unit controls the elevation angle adjusting apparatus to decrease the elevation angle when the current speed value is higher than the target speed value.

5. The manual treadmill of claim 1, wherein when the resistance hasn't yet reached its lower limit of available resistance settings, the control unit doesn't control the elevation angle adjusting apparatus.

6. The manual treadmill of claim 1, wherein the inputting apparatus is able to receive instructions indicating a target elevation angle and to output an elevation angle indication signal, and when the control unit receives the elevation angle indication signal, the control unit controls the elevation angle adjusting apparatus to change the elevation angle accordingly.

7. The manual treadmill of claim 1, wherein the inputting apparatus is able to receive instructions indicating a selection of one of a plurality of the exercise intensity programs which comprises a predetermined elevation angle value and a predetermined speed value and to output a selection signal; when the control unit receives the selection signal, the control unit controls the elevation angle adjusting apparatus to change the elevation angle according to the predetermined elevation angle value and sets the predetermined speed value as the target speed value.

8. The manual treadmill of claim 1, wherein the control unit evaluates a rotating speed of the continuous belt when the resistance has reached a lower limit of available resistance settings and the elevation angle reaches an upper limit of an adjusting scope, the rotating speed of the continuous belt is evaluated according to the variation correlation between the resistance, the elevation angle, and the current speed value, and therefore the control unit is capable of changing an upper limit of the rotating speed of the continuous belt accordingly.

9. The manual treadmill of claim 1, wherein the control unit controls the resistance adjusting apparatus to produce a max resistance or a brake resistance when the control unit receives a speed signal corresponding to a speed of zero for a first predetermined period of time.

10. The manual treadmill of claim 9 further comprising a brake apparatus, and wherein the control unit controls the brake apparatus to produce a brake resistance when the control unit receives a speed signal corresponding to a speed of zero for a first predetermined period of time.

11. The manual treadmill of claim 1 further comprising a brake apparatus, and wherein the control unit controls the brake apparatus to produce a brake resistance when the control unit receives a speed signal corresponding to a speed of zero for a first predetermined period of time.

12. The manual treadmill of claim 11, wherein the control unit controls the brake apparatus to stop the continuous belt in a second predetermined period of time when the control unit receives a stop indication signal.

13. The manual treadmill of claim 1, wherein the control unit controls the resistance adjusting apparatus to stop the continuous belt in a second predetermined period of time when the control unit receives a stop indication signal.

14. A manual treadmill, comprising:

a frame having a fixed portion and a mobile portion which is capable of changing its relative position to the fixed portion;

a continuous belt coupled to the mobile portion of the frame and adapted for a user walking or running on a top surface thereof to drive the continuous belt rotating around the mobile portion cyclically by applying a force from a front portion to a back portion along the top surface by the user, when a relative position of the mobile portion and the fixed portion is changed, an elevation angle of the top surface is changed accordingly;

a sensing apparatus, sensing a parameter corresponding to a current rotating speed of the continuous belt and generating a corresponding speed signal;

an inputting apparatus, generating an indication signal corresponding to an input instruction, wherein the instruction comprises a target rotating speed of the continuous belt;

a resistance adjusting apparatus, generating a resistance to impede the rotation of the continuous belt;

an elevation angle adjusting apparatus coupled between the fixed portion and the mobile portion, capable of changing the relative position of the fixed portion and the mobile portion; and a control unit, receiving the corresponding speed signal from the sensing apparatus to get a current speed value, receiving the indication signal from the inputting apparatus to get a target speed value, and generating a first control signal for controlling the resistance adjusting apparatus and a second control signal for controlling the elevation angle adjusting apparatus;

wherein during a period of time under a control mode, the control unit controls the resistance adjusting apparatus using the first control signal to decrease the resistance when the current speed value is lower than the target speed value and controls the resistance adjusting apparatus to increase the resistance when the current speed value is higher than the target speed value;

wherein when the current speed value is lower than the target speed value, the control unit controls the elevation angle adjusting apparatus to increase the elevation angle when the elevation angle has not reached an upper limit of an adjustable scope and when the resistance has reached a lower limit of available resistance settings.

15. A treadmill, comprising:

a frame;

a continuous belt mounted on the frame, having a top surface for allowing a user to exercise thereon;

a sensing apparatus configured for sensing a speed parameter of the continuous belt and generating a corresponding speed signal;

a resistance adjusting apparatus configured for generating a resistance to impede rotation of the continuous belt;

an elevation angle adjusting apparatus coupled to the continuous belt for changing an elevation angle of the top surface of the continuous belt relative to a ground; and a control unit in communication with the sensing apparatus, the resistance adjusting apparatus and the elevation angle adjusting apparatus, the control unit receiving the corresponding speed signal from the sensing apparatus to get a current speed value, the control unit configured for controlling the resistance adjusting apparatus to decrease the resistance when the current speed value is lower than a predetermined target speed value and to increase the resistance when the current speed value is higher than the predetermined target speed value; wherein when the current speed value is lower than the predetermined target speed value and the resistance has reached a lower limit of available resistance settings, the control unit controls the elevation angle adjusting apparatus to increase the elevation angle until the current speed value reach the predetermined target speed value.

* * * * *